US008742330B2

(12) United States Patent
Taniguchi

(10) Patent No.: US 8,742,330 B2
(45) Date of Patent: Jun. 3, 2014

(54) SPECIFIC PHASE RANGE FOR ION INJECTION INTO ION TRAP DEVICE

(75) Inventor: Junichi Taniguchi, Kyoto (JP)

(73) Assignee: Shimadzu Corporation, Kyoto (JP)

( * ) Notice: Subject to any disclaimer, the term of this patent is extended or adjusted under 35 U.S.C. 154(b) by 0 days.

(21) Appl. No.: 13/458,708

(22) Filed: Apr. 27, 2012

(65) Prior Publication Data

US 2012/0292499 A1 Nov. 22, 2012

(30) Foreign Application Priority Data

May 17, 2011 (JP) ..... 2011-110076

(51) Int. Cl.
*H01J 49/42* (2006.01)
*H01J 49/36* (2006.01)

(52) U.S. Cl.
USPC ..... 250/281; 250/292

(58) Field of Classification Search
USPC ..... 250/281, 282, 286, 287, 290
See application file for complete search history.

(56) References Cited

U.S. PATENT DOCUMENTS 3,937,955 A * 2/1976 Comisarow et al. ..... 250/291
5,739,530 A * 4/1998 Franzen et al. ..... 250/288
5,818,055 A * 10/1998 Franzen ..... 250/292
6,700,116 B2 3/2004 Taniguchi
7,683,316 B2 3/2010 Takeshita et al.
2007/0029473 A1* 2/2007 Verentchikov ..... 250/281
2008/0277580 A1* 11/2008 Takeshita et al. ..... 250/292
2009/0032698 A1* 2/2009 Furuhashi et al. ..... 250/282
2009/0045334 A1* 2/2009 Ding ..... 250/288
2009/0230301 A1* 9/2009 Furuhashi et al. ..... 250/282
2011/0012013 A1* 1/2011 Remes et al. ..... 250/290

FOREIGN PATENT DOCUMENTS

JP 3386048 B2 3/2003
JP 2008-282594 A 11/2008

OTHER PUBLICATIONS

Osamu Furuhashi, et al., "Development of Digital Ion Trap Mass Spectrometer," Shimadzu Review, Jan. 2006, pp. 141-151, vol. 62, No. 3-4.

* cited by examiner

*Primary Examiner* — Nicole Ippolito
*Assistant Examiner* — Brooke Purinton
(74) *Attorney, Agent, or Firm* — Sughrue Mion, PLLC

(57) ABSTRACT

When ions accumulated in the exit side end of ion guide are to be injected into ion trap as packets, the application of square wave high frequency voltage to ring electrode from main voltage generating unit is stopped. Once nearly all the ions have been injected into ion trap, the application of square wave high frequency voltage from main voltage generating unit to ring electrode is momentarily started, at which time the application of square wave high frequency voltage is started from a phase in the range of 90°±40° or 270°±40°. It is thereby possible to reduce the extent of spread of ions immediately after application of high frequency voltage and to improve the ion trapping efficiency.

3 Claims, 8 Drawing Sheets

SPECIFIC PHASE RANGE FOR ION INJECTION INTO ION TRAP DEVICE

TECHNICAL FIELD

The present invention relates to an ion trap device comprising an ion trap which confines ions by means of an AC electric field, which is used in ion trap mass spectrometers, ion trap time-of-flight mass spectrometers, etc.

BACKGROUND ART

Mass spectrometers which employ an ion trap to trap (confine) ions by means of an AC electric field are known in the prior art. A typical ion trap is a so-called three-dimensional quadrupole ion trap comprising a ring electrode of a substantially circular ring shape, and a pair of end cap electrodes arranged so as to sandwich the ring electrode. Generally, in such ion traps, a trapping electric field is formed in the space surrounded by the electrodes by applying a sinusoidal high frequency voltage to the ring electrode, and ions are vibrated and confined by means of this trapping electric field.

In an ion trap mass spectrometer, after trapping the ions to be analyzed in an ion trap, the mass separation function of the ion trap itself is used to selectively eject ions having a specified mass-to-charge ratio from the ion trap, and their ion intensity is detected by means of a detector provided outside the ion trap. Furthermore, in an ion trap time-of-flight mass spectrometer, after trapping the ions to be analyzed in an ion trap, kinetic energy is imparted to the ions and the ions are released at once from the ion trap and injected into a time-of-flight mass spectrometer, in which the ions are separated and detected according to their mass-to-charge ratios. In both cases, in order to detect ions with high sensitivity, it is necessary for ions generated in an outside ion source to be efficiently injected into an ion trap.

To trap ions inside an ion trap, a high frequency voltage is applied to the ring electrode to form a high frequency electric field as described above, but this high frequency electric field becomes a potential barrier for ions trying to enter from outside. Thus, when one attempts to inject ions into the ion trap from outside in a state where a high frequency electric field has been formed, the ions will be bounced back by the aforementioned potential barrier or will rather end up being overly accelerated. As a result, the efficiency of ion injection into an ion trap in a state where a high frequency electric field has been formed was at most on the order of several percent.

To resolve this, in the method described in Patent Literature 1, control is performed whereby the application of high frequency voltage to the ring electrode is temporarily stopped when injecting packetized ions into an ion trap, and is restarted immediately after the ions have been injected into the ion trap. It should be noted that when the sample ionization technique is MALDI, since the sample is irradiated with a pulsed laser light, ions are generated in the form of packets at short intervals, while when an atmospheric ion source is used, such as in the electrospray ionization (ESI) method, ions are generated continuously, so in the device described in Patent Literature 1, the ions are held back in the ion guide and allowed to build up for a while before ejecting them at once from the ion guide, thereby turning a continuous ion stream into packet-like ion groups.

In the aforementioned method, the injection of ions into the ion trap is not hindered by the high frequency electric field, and the ion injection efficiency can be increased. However, when there is no high frequency electric field, no trapping effects on ions is produced, so it is necessary to start the application of high frequency voltage to the ring electrode before the ions that were injected into the ion trap spread out too much. Therefore, in order to properly trap the ions injected into the ion trap, the timing of application of high frequency voltage is important, and that timing needs to be properly adjusted in order to optimize the ion injection efficiency.

In recent years, an ion trap with a digital drive system which performs ion confinement by applying square wave voltage to the ring electrode instead of sine wave voltage—the so-called digital ion trap (DIT)—has been developed (see Non-Patent Literature 1, etc.).

In a DIT, square wave high voltage is generated by switching DC high voltage by means of semiconductor switch and the like, so it has the characteristic of allowing frequency modification of the square wave high voltage, duty ratio control, phase control and the like to be easily performed. Patent Literature 2 describes performing control in a mass spectrometer equipped with such as DIT, whereby, in a state where ions are held inside the ion trap, to additionally inject ions into the ion trap, the application of square wave voltage to the ring electrode is temporarily stopped and is restarted after ion injection. It is disclosed that, in this case, it is necessary to reliably capture the additionally injected ions while preventing the dissipation of ions already trapped in the ion trap, and that a time of 1 to 50 μsec is suitable as the time for stopping the application of square wave voltage.

PRIOR ART LITERATURE

Patent Literature (Patent Literature 1) Japanese Patent No. 3386048
(Patent Literature 2) Japanese Unexamined Patent Application Publication 2008-282594

Non-Patent Literature (Non-Patent Literature 1) Furubashi, Takeshita, Ogawa and Iwamoto: "Development of a digital ion trap mass spectrometer", Shimadzu Review, Shimadzu Review Editorial Department, Mar. 31, 2006, Vol. 62, Nos. 3-4, pp. 141-151

SUMMARY OF THE INVENTION

It is known that when the application of square wave voltage (high frequency voltage) is stopped temporarily at the time of ion injection as described above, the timing of the stoppage and restarting of voltage application is important for improving the ion trapping efficiency, but based on investigations by the present inventor, it was discovered that, in the case of a DIT in particular, the phase of the square wave voltage when its application is restarted also affects the ion trapping efficiency.

The present invention was made in view of this point, its main object being to further improve the trapping efficiency of ions injected from outside and trapped in an ion trap device employing a DIT.

The ion trap device according to the present invention, made to resolve the aforementioned problem, is an ion trap device comprising an ion source which supplies pulsed ions and an ion trap which traps the ions supplied from said ion source by means of an electric field formed in a space surrounded by a plurality of electrodes, characterized in that it comprises a) a voltage application means which applies a square wave high frequency voltage to at least one of the plurality of electrodes making up said ion trap in order to form a high frequency electric field for capturing ions in said ion trap; and b) a control means which controls said voltage application means so as to inject the ions supplied in pulses from said ion source into said ion trap in a state where said square wave high frequency voltage is not applied to said at least one electrode, and start the application of said square wave high frequency voltage from a specified phase after a predetermined period of time has elapsed in order to trap the injected ions.

In a typical form of the ion trap device of the present invention, the aforementioned ion trap can be configured as a three-dimensional quadrupole ion trap comprising a ring electrode and a pair of end cap electrodes arranged so as to sandwich the ring electrode. In this case, the voltage application means applies a square wave high frequency voltage to the ring electrode, and can therefore form a high frequency electric field for capturing ions in the space inside the ion trap.

In the ion trap device of the present invention, when the ions supplied from the ion source are injected into the ion trap through an ion injection hole formed in the entry side end cap electrode, for example, the square wave high frequency voltage is not applied to the ring electrode and a high frequency electric field for trapping ions is not present in the ion trap. This high frequency electric field would form a potential barrier to the ions trying to enter through the ion injection hole, but since this barrier is not present, the ions are injected into the ion trap smoothly and at a proper velocity without being bounced back from the ion injection hole and without having excess energy imparted to them.

However, since there is no high frequency electric field, ions which have entered into the ion trap will tend to disperse. In this state where the behavior of the ions is not constrained by a high frequency electric field, the application of a square wave high frequency voltage to the ring electrode is started and a high frequency electric field is formed. The action of the trapping high frequency electric field on the ions alternates in every half-cycle of the square wave high frequency voltage between the action of compressing ions in the direction along the axis of rotation of the ring electrode near the center while expanding in the direction orthogonal thereto, and conversely, the action of compressing ions near the center in the direction orthogonal to the axis of rotation of the ring electrode while expanding in the direction along the axis of rotation. Thus, when the high frequency electric field is suddenly formed from the state where no high frequency electric field exist, the state of the electric field at its starting point, i.e. the phase of the square wave high frequency voltage, greatly affects the behavior of the ions.

According to present inventor's simulation computations of ion behavior, it can be confirmed that if the phase of the square wave high frequency voltage at the time its application is started is near 0°, immediately thereafter the ions will expand in a direction along the axis of rotation of the ring electrode, and when that phase is near 180°, immediately thereafter the ions will expand in a direction perpendicular to the axis of rotation of the ring electrode. Furthermore, it was confirmed that if the phase of the square wave high frequency voltage at the start of its application is near 90° and near 270°, the ions will assume a suitably compressed state both in the direction of rotation of the ring electrode and in the direction orthogonal thereto. In actuality, there is a high probability of dissipation of ions which describe a trajectory greater than approximately ⅔ of the inscribed radius of the ring electrode and approximately ⅔ of the distance of the end cap electrodes from the ion trap center, so from that standpoint, the phase range in which the ion vibration amplitude will stay within a suitable range of the space within the ion trap is judged to be 90°±40° and 270°±40° Based on this, the aforementioned specified phase in the ion trap device of the present invention is preferably set to a range of 90°±40° or a range of 270°±40°.

With the ion trap device of the present invention, since no high frequency electric field for trapping ions is formed when ions are injected into the ion trap, it is possible to inject ions efficiently, and to capture ions efficiently by means of a high frequency electric field after the ions have been injected. As a result, the ion trapping efficiency is improved over the prior art and a greater quantity of ions can be supplied for mass analysis, making it possible to improve the analytical sensitivity and analytical precision.

DETAILED DESCRIPTION OF THE EXEMPLARY EMBODIMENT

Figure 1:
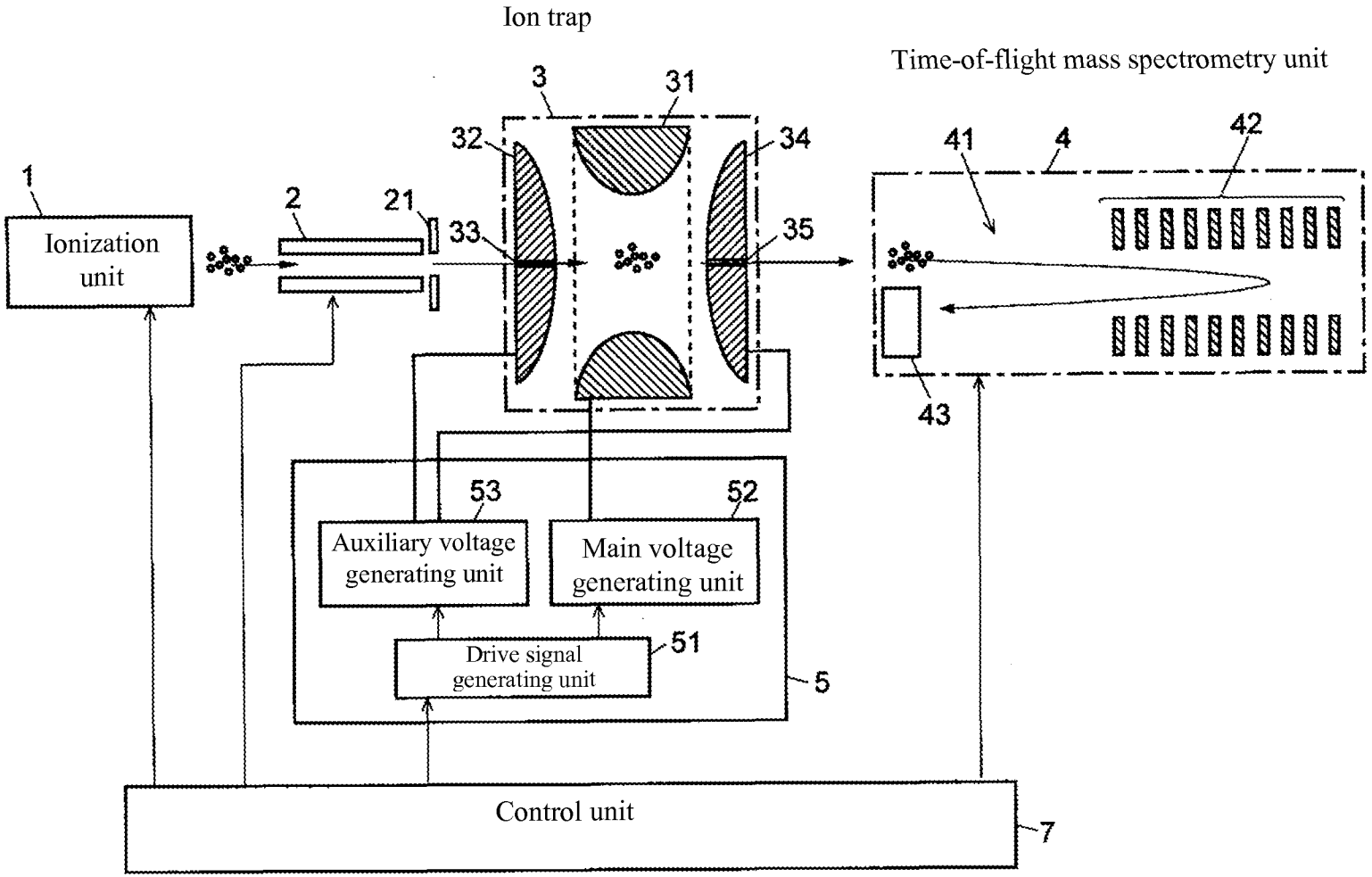
FIG. 1 An overall diagram of an ion trap time-of-flight mass spectrometer according to an example of embodiment of the present invention.

An ion trap time-of-flight mass spectrometer which is an example of embodiment of the ion trap device of the present invention will be described in detail with reference to the appended drawings. FIG. 1 is an overall diagram of the ion trap time-of-flight mass spectrometer according to the present example of embodiment.

This mass spectrometer comprises an ionization unit 1, an ion guide 2, a three-dimensional quadrupole ion trap 3, and a time-of-flight mass spectrometry unit 4. For example, the ionization unit 1 may be an electrospray ion source which ionizes sample ingredients in a liquid sample under atmospheric pressure or some other atmospheric pressure ion source, or an ion source which performs ionization under a vacuum rather than under atmospheric pressure. The ion guide 2 has a multipole rod configuration, wherein a portion of the exit end of the multipole rod electrodes is coated with a resistor in order to compress the ions as described below and guide them into ion trap 3 described below, the formation of a potential well at the exit side is made possible, and an exit side gate electrode 21 is provided on the outside.

The ion trap 3 comprises a single ring electrode 31 with a round ring shape, whereof the inside surface has the shape of a hyperboloid of revolution of one sheet; and a pair of end cap electrodes 32 and 34 which are provided opposite each other so as to sandwich the ring electrode and whereof the inside surface has the shape of a hyperboloid of revolution of two sheets, with the space surrounded by these electrodes 31, 32 and 34 being the trapping region. An ion injection hole 33 is formed in the center of the entrance side end cap electrode 32, and an ion ejection hole 35 is formed on the exit side end cap electrode 34 substantially on the same line as the ion injection hole 33.

The time-of-flight mass spectrometry unit 4 comprises a flight space 41 with a reflector 42, and an ion detector 43, and separates and detects various types of ions to which a given kinetic energy is imparted in, and which are outputted from, ion trap 3, in accordance with the mass-to-charge ratio m/z.

Ion trap drive unit 5 comprises a drive signal generating unit 51 controlled by control unit 7; a main voltage generating unit 52 which applies a predetermined voltage to ring electrode 31; and an auxiliary voltage generating unit 53 which applies a predetermined voltage to end cap electrodes 32 and 34. Ion trap 3 is a so-called digital ion trap (DIT), and main voltage generating unit 52 comprises a circuit which generates a square wave high frequency voltage by switching a DC voltage ±V according to a control pulse provided from drive signal generating unit 51.

Figure 2:
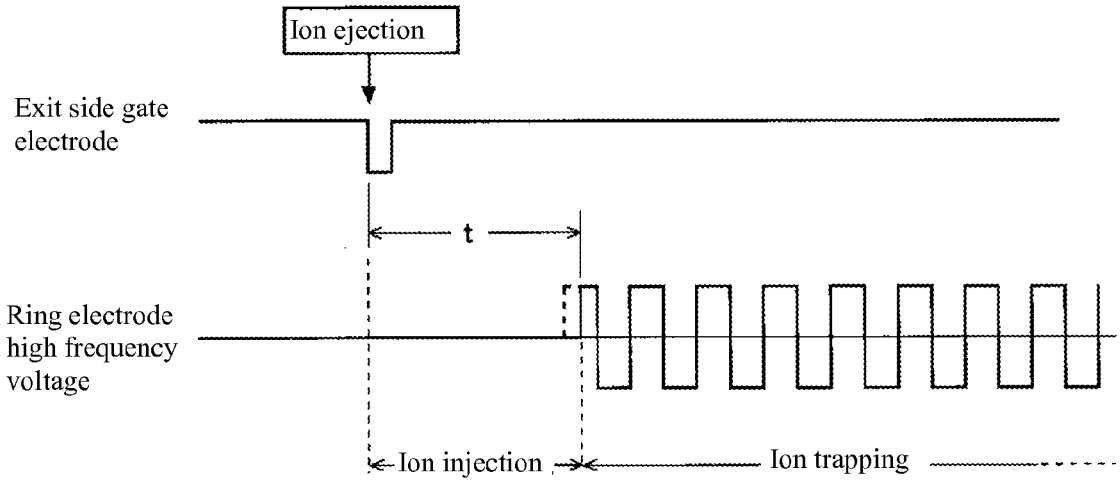
FIG. 2 A diagram of control timing in the ion trap time-of-flight mass spectrometer of the present example of embodiment.
Figure 3A:
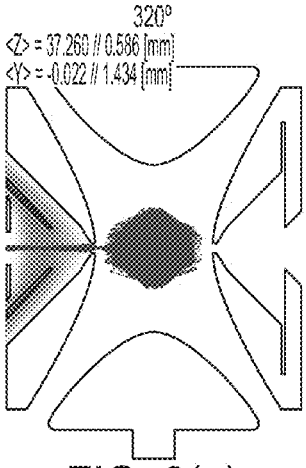
FIG. 3 A drawing illustrating the results of a simulation of the relationship between the phase of high frequency voltage initially applied to the ring electrode and the spread of ions within the ion trap (phase: 320° to 40°).
Figure 3B:
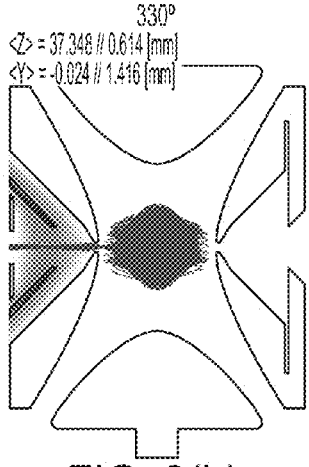
Figure 3C:
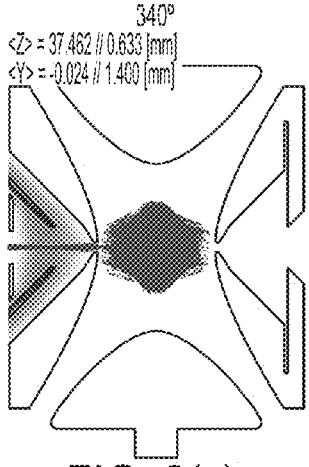
Figure 3D:
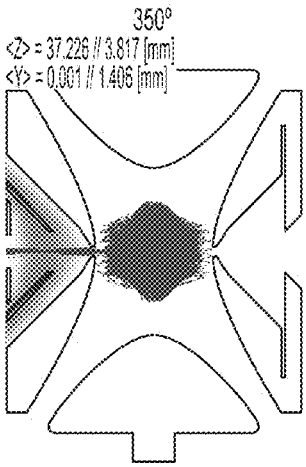
Figure 3E:
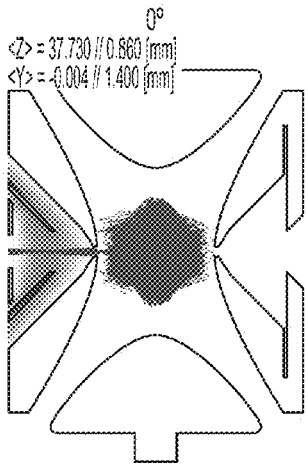
Figure 3F:
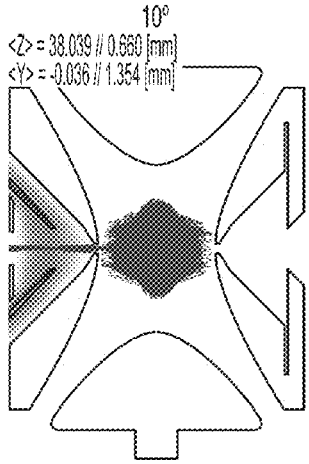
Figure 3G:
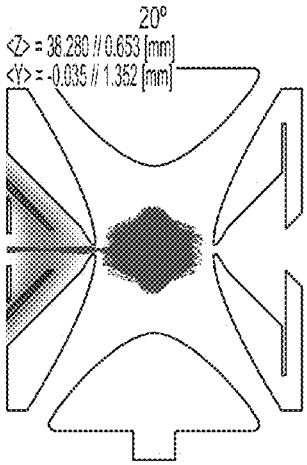
Figure 3H:
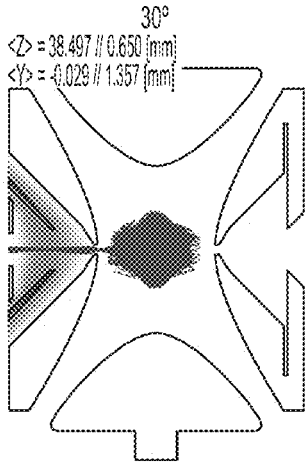
Figure 3I:
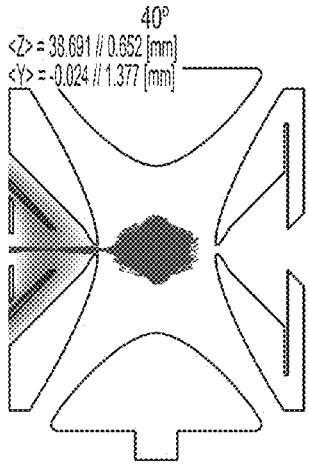
Figure 4A:
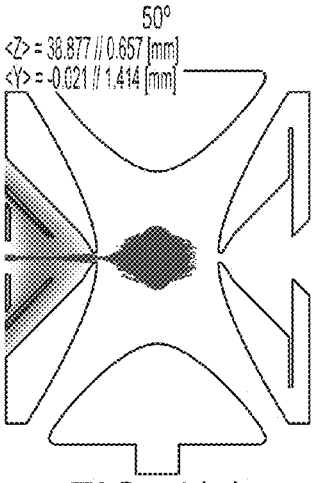
FIG. 4 A drawing illustrating the results of a simulation of the relationship between the phase of high frequency voltage initially applied to the ring electrode and the spread of ions within the ion trap (phase: 50° to 130°).
Figure 4B:
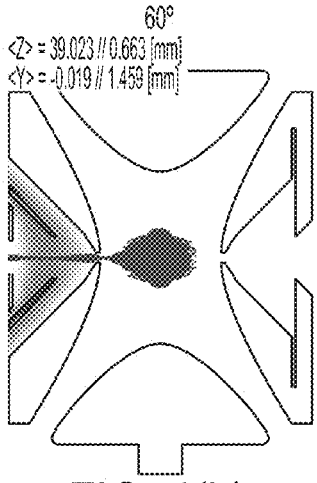
Figure 4C:
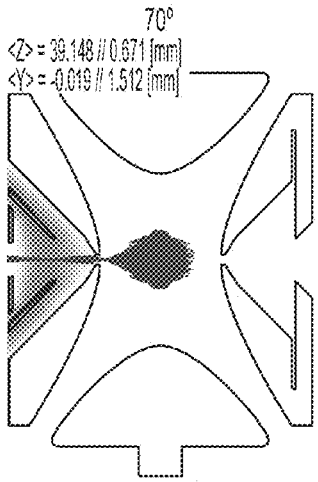
Figure 4D:
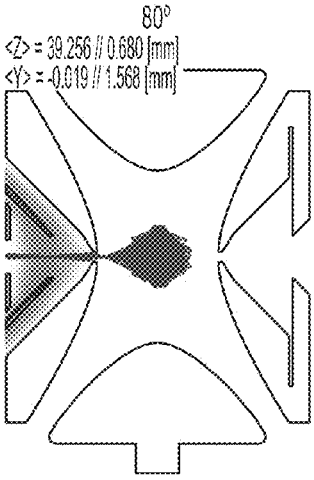
Figure 4E:
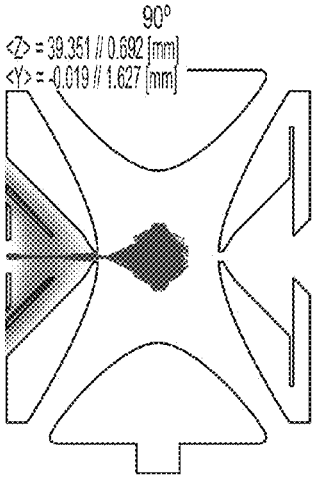
Figure 4F:
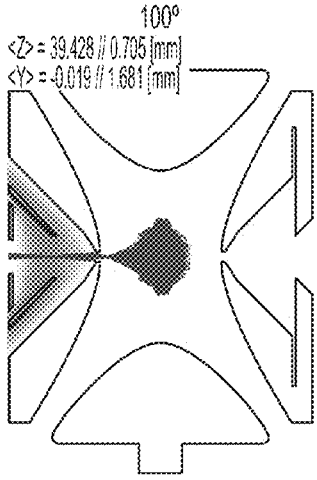
Figure 4G:
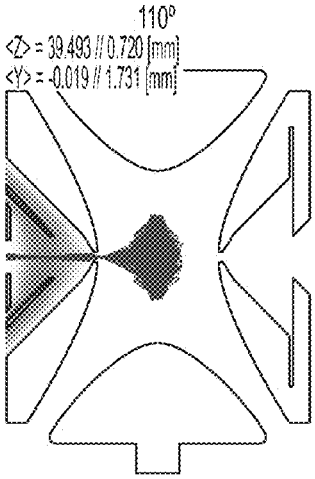
Figure 4H:
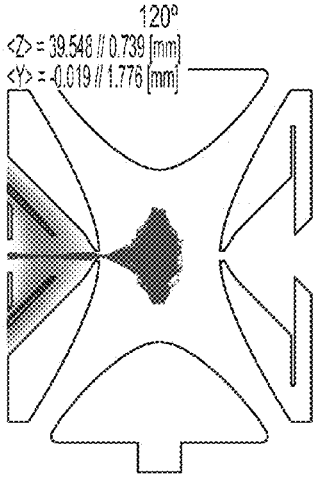
Figure 4I:
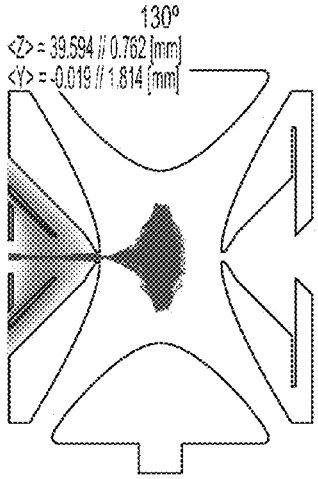
Figure 5A:
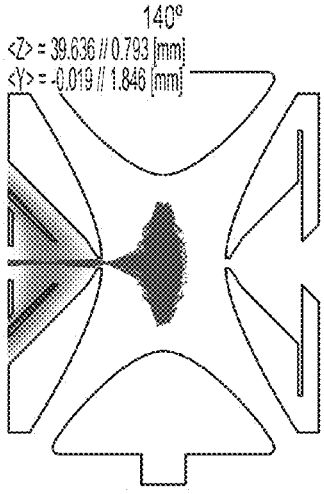
FIG. 5 A drawing illustrating the results of a simulation of the relationship between the phase of high frequency voltage initially applied to the ring electrode and the spread of ions within the ion trap (phase: 140° to 220°).
Figure 5B:
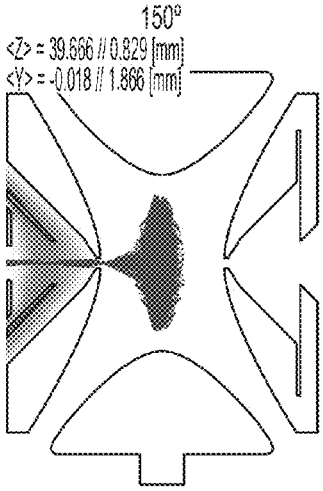
Figure 5C:
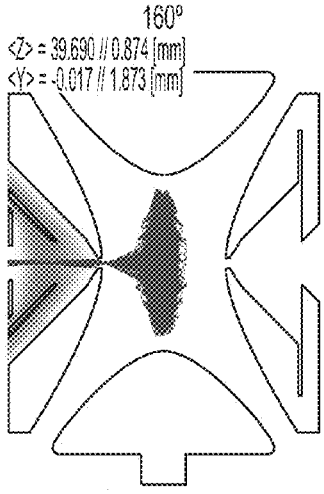
Figure 5D:
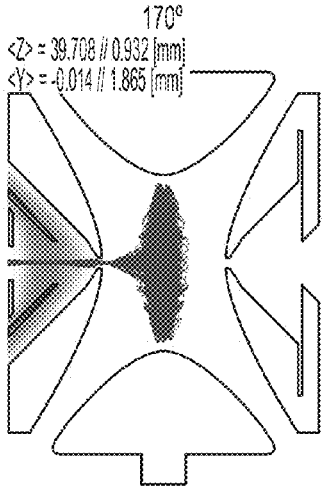
Figure 5E:
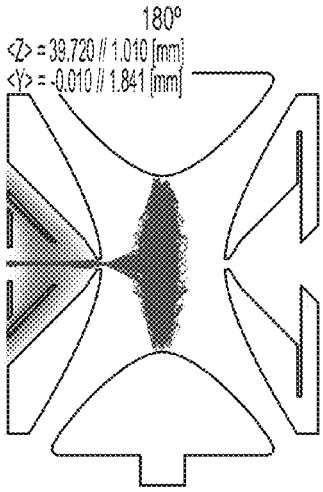
Figure 5F:
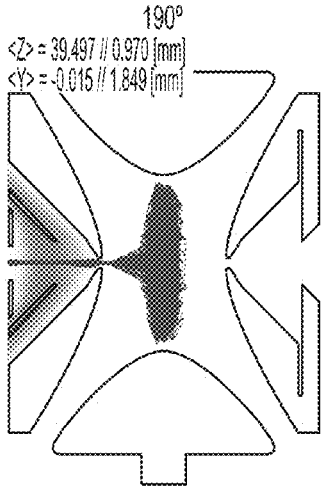
Figure 5G:
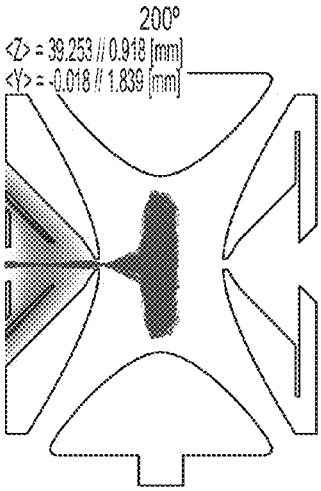
Figure 5H:
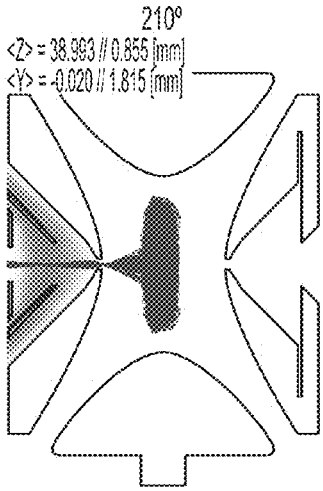
Figure 5I:
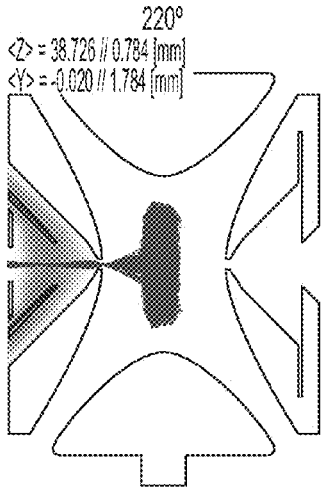
Figure 6A:
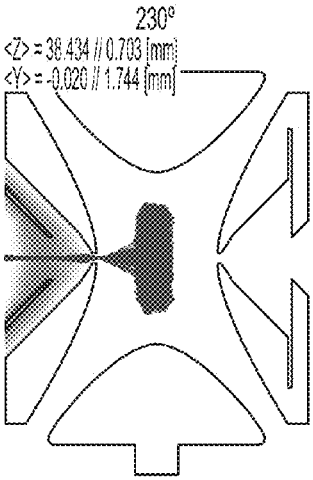
FIG. 6 A drawing illustrating the results of a simulation of the relationship between the phase of high frequency voltage initially applied to the ring electrode and the spread of ions within the ion trap (phase: 230° to 310°).
Figure 6B:
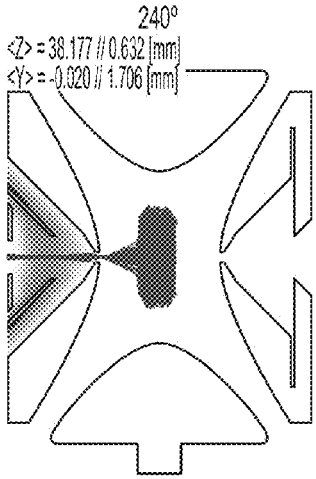
Figure 6C:
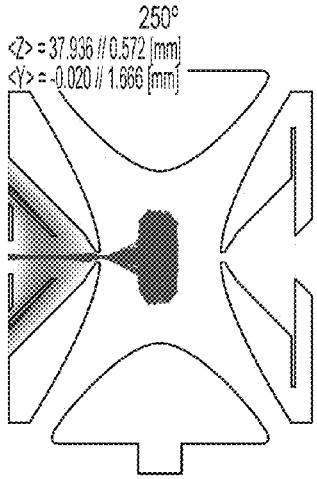
Figure 6D:
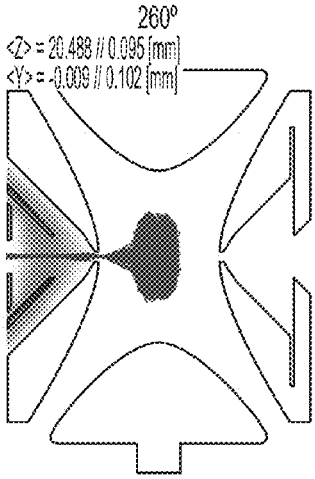
Figure 6E:
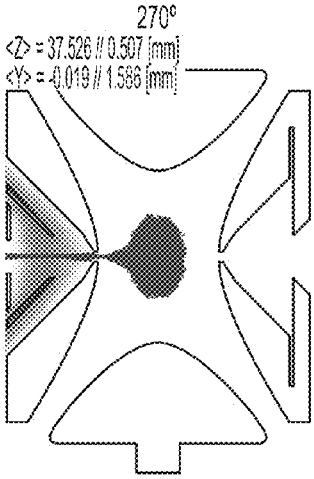
Figure 6F:
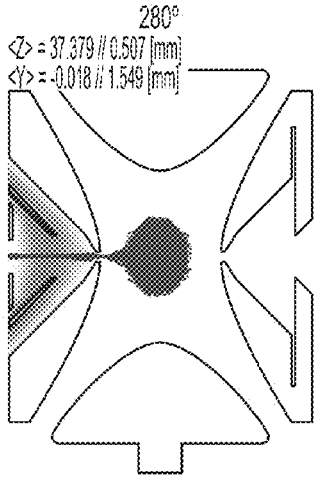
Figure 6G:
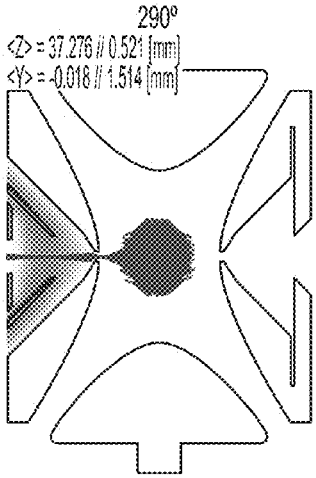
Figure 6H:
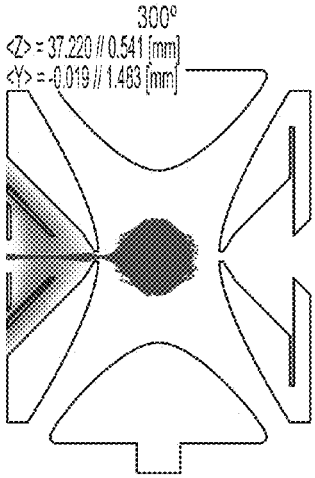
Figure 6I:
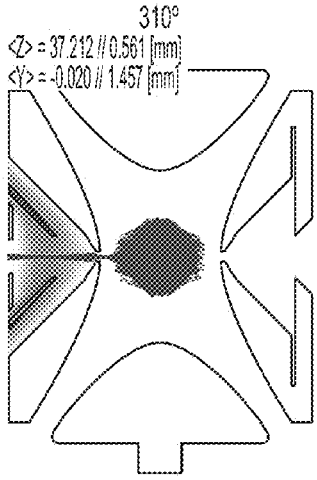

The basic analysis operation of the ion trap time-of-flight mass spectrometer of the present example of embodiment will be explained by referring to FIG. 2 in addition to FIG. 1. FIG. 2 is a diagram of the control timing in the ion trap time-of-flight mass spectrometer of the present example of embodiment.

Ions generated in ionization unit 1 are injected into ion guide 2, at which time the exit side gate electrode 21 is closed, a potential well is formed on the exit side end of the ion guide 2, and ions are temporarily accumulated in this well. After accumulating ions in the potential well of ion guide 2 for a predetermined period of time, the voltage applied to the exit side gate electrode 21 is changed, thereby sending the accumulated ions out at once toward the ion trap 3, as shown in FIG. 2. When sending out ions from the ion guide 2 to the ion trap 3, the application of high frequency voltage from the main voltage generating unit 52 to the ring electrode 31 is stopped, 0 V is applied from auxiliary voltage generating unit 53 to the entrance side end cap electrode 32, and a predetermined DC voltage of the same polarity as the polarity of the ions is applied to the exit side end cap electrode 34.

As a result, ions outputted in packets from the ion guide 2 are guided into the ion trap 3 through the ion injection hole 33 without being reflected by the entrance side end cap electrode 32, and are reflected by a DC electric field of the same polarity as the ions upon approaching the exit side end cap electrode 34. The ions accumulated in the potential well of the ion guide 2 are quickly guided into the ion trap 3, and once a predetermined period of time t has elapsed from the time of ion ejection, the main voltage generating unit 52 momentarily starts the application of square wave high frequency voltage to the ring electrode 31, forming a high frequency electric field for trapping in the ion trap 3. The predetermined time period t is suitably determined in advance as the time when all or nearly all of the ions ejected from the ion guide 2 have been guided into the ion trap 3. Furthermore, the application of square wave high frequency voltage to the ring electrode 31 is started from a specified predetermined phase. In FIG. 2, the timing is such that the application of square wave high frequency voltage is started from the 90° phase position of said voltage, but this is only one example, and any phase within the predetermined phase range described below can be selected.

When a square wave high frequency voltage is applied to the ring electrode 31 and a high frequency electric field is formed as described above, the ions which have been injected into the ion trap 3 are trapped. Then, a cooling gas is introduced into the ion trap 3 from an unillustrated gas supply unit and the ions collide with the cooling gas to attenuate the kinetic energy of the ions and gather the ions near the center of the ion trap 3. Then a large DC voltage of the same polarity as the ions is applied to the entrance side end cap electrode 32 from the auxiliary voltage generating unit 53 at a predetermined timing, imparting kinetic energy to the ions, and the ions are ejected at once through the ion ejection hole 35. The ejected ions are fed into flight space 41, and as they fly back from the reflecting electric field formed by reflector 42, a difference develops in their times of flight based on their mass-to-charge ratio, until they finally reach the ion detector 43 and are successively detected.

It will be noted that it is also possible to introduce a collision-induced dissociation gas into the ion trap 3 after the ions have been trapped in the ion trap 3, and to oscillate the ions through resonant excitation to promote the dissociation of the ions and analyze the various product ions generated by dissociation using the time-of-flight mass spectrometry unit 4.

To increase the analytical sensitivity and analytical precision in the mass spectrometry as described above, it is important to increase the quantity of ions fed into the time-of-flight mass spectrometry unit 4 as much as possible, and to this end, it is necessary for the ions generated in ionization unit 1 and accumulated in the potential well of ion guide 2 to be efficiently guided into and trapped inside the ion trap 3. As described above, in order to efficiently trap the ions which have been guided into the ion trap 3 through the ion injection hole 33, in other words, in order to minimize ion losses, it is important to properly determine the timing of starting the application of square wave high frequency voltage, i.e. time period t, and at the same time to properly determine the phase at which the application of square wave high frequency voltage is to be started.

The high frequency electric field formed in the ion trap 3 due to the high frequency voltage applied to the ring electrode 31 alternately has the effect on the ions inside ion trap 3 of moving them away from the center of the ion trap 3 and the effect of moving them toward the center of the ion trap 3. Thus, the cloud-like cluster of ions inside the ion trap 3 alternates between expansion and contraction in sync with the cycling of the high frequency voltage. In particular, when a high frequency voltage is momentarily applied and a high frequency electric field is formed from a state where no high frequency electric field exists and thus no constraining force due to the high frequency electric field is present in the ion trap 3, the behavior of ions immediately thereafter is assumed to be highly susceptible to the effects of phase at the time the application of the voltage is started. Thus, the present inventor performed analysis of ion trajectories through simulation calculations in order to understand the relationship between the phase of the square wave high frequency voltage applied to the ring electrode 31 at the time the application thereof is started and the behavior of ions immediately thereafter.

FIG. 3 through FIG. 6 are drawings which show the results of calculations of ion trajectories. Namely, ions of m/z 609 are injected into ion trap 3 through ion injection hole 33 from outside the ion trap 3, and a square wave high frequency voltage waveform is applied to the ring electrode 31 the moment the ions reach the vicinity of the center of the ion trap 3. The voltage amplitude of this square wave high frequency voltage is set at 700 V and the frequency is set at 500 kHz. FIG. 3 through FIG. 6 describe the ion trajectories over a 50 μsec interval when the phase of the initially applied square wave high frequency voltage is changed in 10° increments.

Comparing the four results for 0° in FIG. 3 (*e*), 90° in FIG. 4 (*e*), 180° in FIG. 5 (*e*) and 270° in FIG. 6 (*e*), it was found that, at phase 0°, the ions were generally expanded in a direction along the axis of rotation of the ring electrode 31 (the axis linking the center of the ion injection hole 33 and the center of the ion ejection hole 35), and conversely, at phase 180°, the ions were generally expanded in the direction orthogonal to the axis of rotation of the ring electrode 31 (the direction of the plane containing the apex of the ring electrode 31 oriented inward into the ion trap 3). At the phase between the two, i.e. at the phases of 90° and 270°, the ions were found to be relatively compressed in both the direction along the axis of rotation of the ring electrode 31 and in the direction orthogonal thereto, and were contained in a relatively narrow space.

In an actual device, when the ions inside the ion trap 3 move far away from the center of the ion trap 3 and get too close to the ring electrode 31 and end cap electrodes 32 and 34, the ion trajectory becomes unstable and there is a high possibility of dissipation due to contact with the electrodes 31, 32, 34 or ejected through ion injection hole 33 and ion ejection hole 35. According to investigations by the present inventor, ions describing a trajectory which deviates from the range circumscribed by ⅔ of the inscribed radius of the ring electrode 31 and ⅔ of the distance of the end cap electrodes 32 and 34 from the center of the ion trap 3 have a high probability of dissipating, so here, it is the objective of trapping to make the ions describe a trajectory which does not deviate from that range. Based on the results in FIGS. 3 through 6, the phase ranges that can achieve this objective are centered on 90° and 180°, ±40° approximately. In other words, it can be said that 50° to 130° and 140° to 220° are suitable ranges for the phase of the initially applied square wave high frequency voltage.

Figure 7:
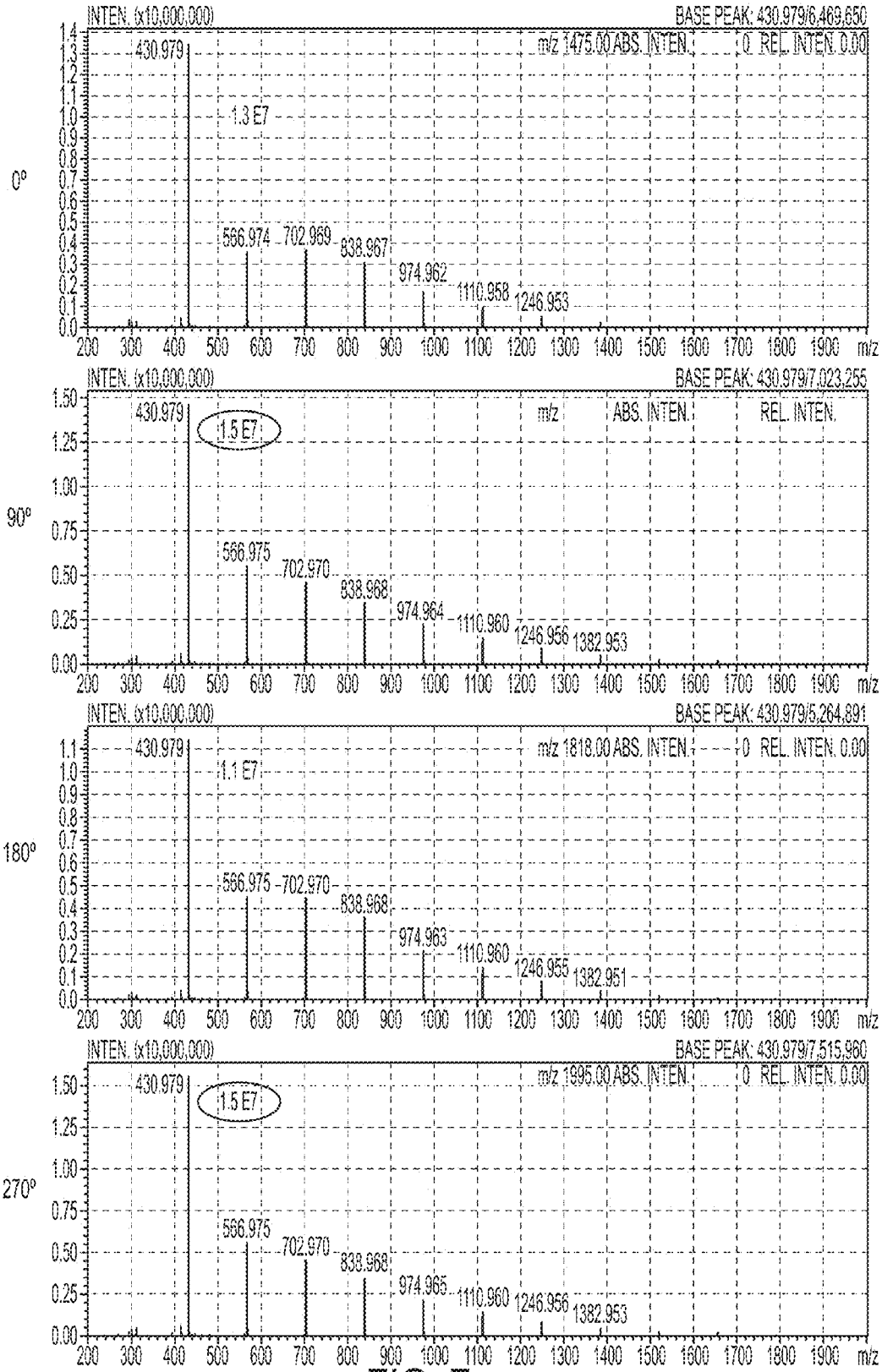
FIG. 7 A drawing illustrating the mass spectrum measured when the phase of high frequency voltage initially applied to the ring electrode was changed.
Figure 8:
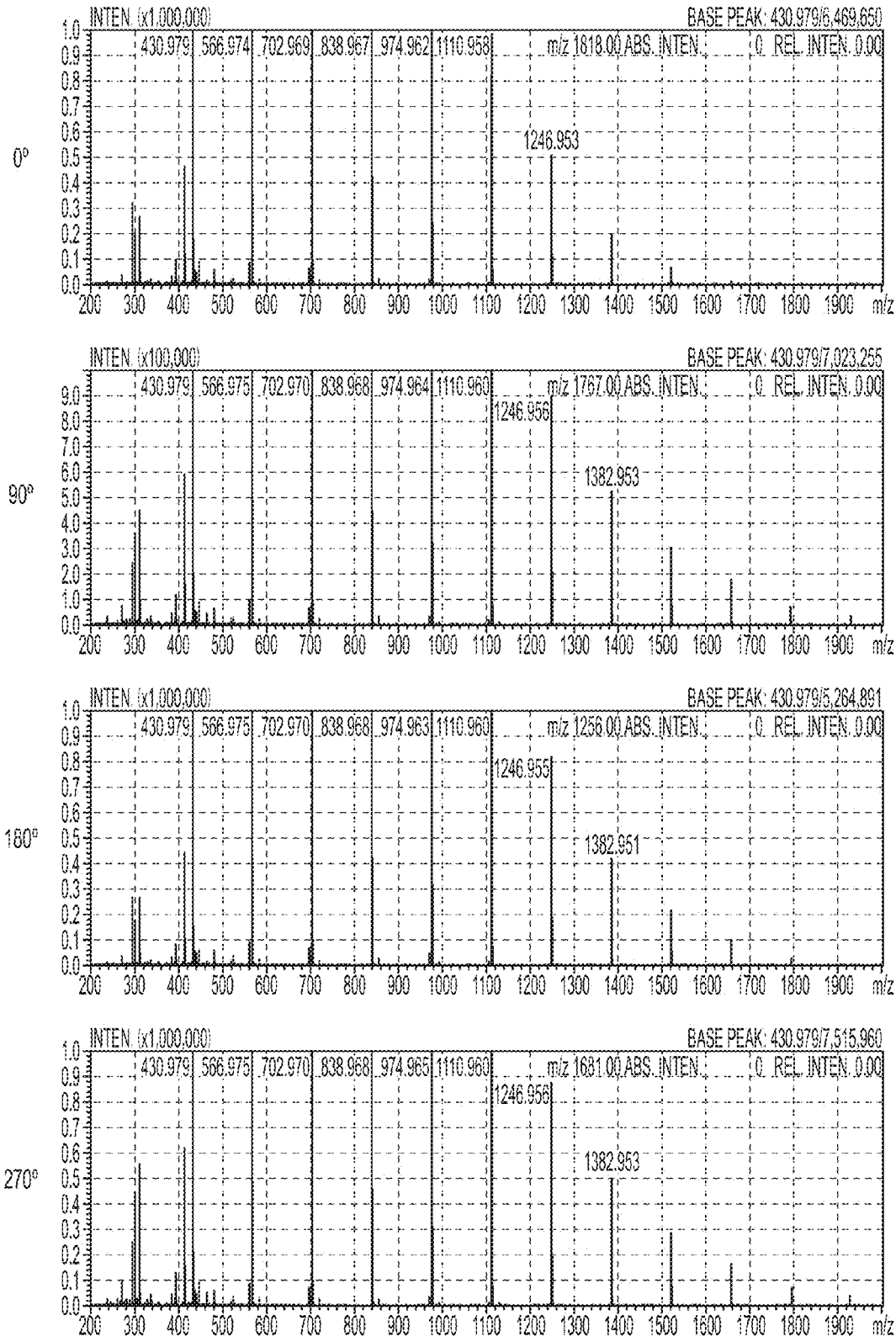
FIG. 8 A drawing illustrating the mass spectrum measured when the phase of high frequency voltage initially applied to the ring electrode was changed (enlargement of vertical axis of FIG. 7).

To confirm the effect of properly setting the phase of the initially applied square wave high frequency voltage as described above, the mass spectrum for a NaTFA sample was measured with the phase set to 0°, 90°, 180° and 270°. The results are shown in FIG. 7, and an enlargement of the vertical axis of FIG. 7 is shown in FIG. 8. The signal intensity at m/z 430, which is the 0 base peak, was $1.3\times10^7$ in the case of phase 0° and $1.1\times10^7$ in the case of phase 180°, while in the case of phase 90° and 270°, the signal intensity was improved by about 10 to 20%. Furthermore, in the region with a large mass-to-charge ratio, it was found that ions were detected in the case of phase 90° and 270° which were hardly detected in the case of 0° and 180°. Based on these measurement results, it can be confirmed that making the phase of the initially applied square wave high frequency voltage 90° or 270° shows an increase in the amount of ions supplied to mass spectrometry and an improvement in the analytical sensitivity.

It will be noted that the phase when application of square wave high frequency voltage is started at the time of injection of ions into the ion trap 3 may be set in advance to one value within the aforementioned range, but when performing mass spectrometry of ions with a specific mass-to-charge ratio or a specific mass-to-charge ratio range, there may be a more suitable phase within the aforementioned phase range. Thus, one may also perform automatic calibration (tuning) for the target mass-to-charge ratio or mass-to-charge ratio range to find the phase that will maximize the signal intensity.

Furthermore, the example of embodiment described above is no more than one example of the present invention, and modifications, additions and corrections which may be performed within the gist of the present invention are naturally included within the scope of patent claims of the present application.

For example, in the above-described example of embodiment, mass spectrometry was performed by means of a time-of-flight mass spectrometry unit, but it is also possible to perform mass separation of ions in the ion trap itself. Furthermore, in the above-described example of embodiment, the ionization unit 1 continuously ionizes samples, so an ion guide 2 with an ion holding function was used in order to inject ions into the ion trap 3 in pulsed fashion, but if the ionization unit 1 is MALDI ion source or the like, which generates ions in pulsed fashion, a configuration whereby the ions generated in pulsed fashion in the ionization unit 1 are directly injected into the ion trap 3 can be used.

EXPLANATION OF REFERENCES

1 . . . ionization unit
2 . . . ion guide
21 . . . exit side gate electrode
3 . . . ion trap
31 . . . ring electrode
32 . . . entrance side end cap electrode
33 . . . ion injection hole
34 . . . exit side end cap electrode
35 . . . ion ejection hole
4 . . . time-of-flight mass spectrometry unit
41 . . . flight space
42 . . . reflector
43 . . . ion detector
5 . . . ion trap drive unit
51 . . . drive signal generating unit
52 . . . main voltage generating unit
53 . . . auxiliary voltage generating unit
7 . . . control unit

What is claimed is:

1. An ion trap device comprising an ion source which supplies pulsed ions and an ion trap which traps the ions supplied from said ion source by means of an electric field formed in a space surrounded by a plurality of electrodes, characterized in that it comprises a) a voltage application means which applies a square wave high frequency voltage to at least one of the plurality of electrodes making up said ion trap in order to form a high frequency electric field for capturing ions in said ion trap; and b) a control means which controls said voltage application means so as to inject the ions supplied in pulses from said ion source into said ion trap in a state where said square wave high frequency voltage is not applied to said at least one electrode, and start the application of said square wave high frequency voltage from a specified phase after a predetermined period of time has elapsed in order to trap the injected ions, wherein the specified phase is at an intermediate point of a single duty cycle of the square wave.

2. An ion trap device as described in claim 1, characterized in that said specified phase is in the range of 90°±40°, or the range of 270°±40°.

3. An ion trap device as described in claim 2, characterized in that said ion trap is a three-dimensional quadrupole ion trap comprising a ring electrode and a pair of end cap electrodes arranged so as to sandwich said ring electrode, and said voltage application means applies square wave high frequency voltage to said ring electrode.

* * * * *